US006457940B1

(12) United States Patent
Lehman

(10) Patent No.: US 6,457,940 B1
(45) Date of Patent: Oct. 1, 2002

(54) MOLTEN METAL PUMP

(76) Inventor: Dale T. Lehman, 5577 Valley La., Solon, OH (US) 44139

( * ) Notice: Subject to any disclaimer, the term of this patent is extended or adjusted under 35 U.S.C. 154(b) by 0 days.

(21) Appl. No.: 09/621,201

(22) Filed: Jul. 21, 2000

Related U.S. Application Data

(60) Provisional application No. 60/145,366, filed on Jul. 23, 1999.

(51) Int. Cl.[7] ..... F04D 7/06; B23P 15/04

(52) U.S. Cl. ..... 415/206; 29/889.4; 415/121.2; 416/235

(58) Field of Search ..... 415/200, 121.2, 415/206; 29/889.4; 416/247 R, 228, 235, 236 R, 182, 181, 185

(56) References Cited

U.S. PATENT DOCUMENTS

| | | | | |
|---|---|---|---|---|
| 2,808,782 A | | 10/1957 | Thompson et al. | 103/37 |
| 2,934,245 A | | 4/1960 | Emeny | 222/330 |
| 3,575,525 A | | 4/1971 | Fox | 415/215 |
| 3,776,660 A | | 12/1973 | Anderson et al. | 415/196 |
| 3,984,234 A | | 10/1976 | Claxton et al. | 75/68 R |
| 4,426,068 A | | 1/1984 | Gimond et al. | 266/217 |
| 4,491,474 A | | 1/1985 | Ormesher | 75/65 R |
| 4,786,230 A | | 11/1988 | Thut | 415/88 |
| 5,192,193 A | | 3/1993 | Cooper et al. | 416/186 R |
| 5,203,681 A | | 4/1993 | Cooper | 417/424.1 |
| 5,470,201 A | | 11/1995 | Gilbert et al. | 415/200 |
| 5,558,505 A | | 9/1996 | Mordue et al. | 417/360 |
| 5,597,289 A | | 1/1997 | Thut | 415/200 |
| 5,685,701 A | * | 11/1997 | Chandler et al. | 417/424.1 |
| 5,944,496 A | * | 8/1999 | Cooper | 417/423.3 |
| 6,019,576 A | | 2/2000 | Thut | 415/200 |
| 6,152,691 A | * | 11/2000 | Thut | 415/197 |
| 6,254,340 B1 | * | 7/2001 | Vild et al. | 415/200 |
| 6,303,074 B1 | | 10/2001 | Cooper | 266/235 |

* cited by examiner

*Primary Examiner*—Edward K. Look
*Assistant Examiner*—Richard A. Edgar
(74) *Attorney, Agent, or Firm*—Pearne & Gordon LLP

(57) ABSTRACT

An impeller for a molten metal pump includes an exterior bearing mounting surface that is trued about the axis of the impeller and drive shaft assembly. Another impeller arrangement includes a pumping chamber having an axis offset from the impeller axis to achieve a volute pumping arrangement. In a further arrangement, the impeller is provided with peripheral pumping chambers intersecting the peripheral surface of the impeller. In each of the foregoing arrangements, a plate may be fixed to the pump drive shaft at a location axially spaced from the impeller inlet to screen debris and to pump molten metal to the impeller inlet.

37 Claims, 7 Drawing Sheets

20
30
18
32
32
17
28
16
10
22
24
26
26
64
69
55a
52
12
34
55
38
14
42

MOLTEN METAL PUMP

This application claims the priority of U.S. Provisional Application No. 60/145,366, filed Jul. 23, 1999.

BACKGROUND OF THE INVENTION AND RELATED ART

The present invention relates to pumps, and more particularly to pump apparatus and methods for pumping molten metal.

The use of pumps to pump molten metal such as aluminum or zinc is known in the art. There are three basic types of molten metal pumps described in detail in prior U.S. Pat. No. 5,203,681. Generally, molten metal pumps comprise centrifugal pumps modified to provide processing of the molten metal. To that end, circulation pumps are used to equalize temperature and improve homogeneity of mixture in a molten metal bath, transfer pumps are used to convey or transfer molten metal between locations and gas-injection pumps are used to circulate and inject gas into a molten metal to modify its composition as by removing dissolved gases or dissolved contaminant metals therefrom.

The pumps typically include a base or casing having a pumping chamber and an impeller received within the chamber. The base includes inlet and outlet passages for intake and discharge of the molten metal being pumped. The pump may be a volute pump wherein the pumping chamber has a volute shape comprising a spiral configuration of circumferentially increasing cross sectional area approaching the pump outlet passage. It is also possible to provide the pump with a pumping chamber having a generally circular shape.

The pump base together with the impeller are submerged in the molten metal and connected via a plurality of support posts to a drive arrangement positioned above the level of the molten metal. The impeller is supported for rotation within the pumping chamber by a rotatable shaft coupled to the drive arrangement. In typical installations, the drive shaft may be of various lengths, e.g. one to four feet in length or longer, in order to provide adequate clearance above the molten metal level.

The portions of the pump submerged in the molten metal are directly contacted and exposed to the harsh conditions thereof, and they are formed of refractory materials such as graphite, silicon carbide, alumina, zirconia or hexaloy. Typical aluminum processing temperatures are in the order of 1200 to 1400° F. The aluminum is corrosive at these temperatures and abrasive dross as well as other particulate or solid contaminants are present in the molten metal.

In such aluminum processing, the submerged pump components are typically made of a refractory material such as graphite to inhibit and/or retard damage due to the environment. However, cavitation and turbulence damage is not sufficiently retarded by material selection alone. That is, the violent agitation of the molten metal by the impeller rotation has been found to cause excessive pitting, abrasion and/or spalling of the graphite at the impeller surfaces. In molten metal pumps where the level of the molten metal is reduced during operation, the intimate contact of air and aluminum and/or the oxidizing of the aluminum give rise to a cavitation type defect wherein localized increased concentrations of aluminum oxide and/or turbulent flowing metal worsen the damage to the graphite pump components, especially the impeller. Accordingly, the cavitation and turbulence adjacent the impeller is believed to exacerbate the harshness of the environment and increase the resulting damage. This has been found to be particularly true in respect to the surfaces at the radially interior, low pressure region of the impeller.

A typical impeller includes at least two axially extending vanes and a radially extending member which forms a base when located below the vanes. If the impeller includes a base, the adjacent vanes and base form a pocket which may entrap molten metal when the pump is removed from operation. In such cases, removal of the pump from the molten metal may create a safety hazard due to trapped molten metal. That is, the trapped molten metal may remain molten and subsequently contact a worker withdrawing and/or servicing the pump.

The necessary spacing between the driver and impeller results in the use of an elongate drive shaft fixed to the impeller. This requires a relatively high degree of balance during operation, and accordingly, a bearing support between the impeller/shaft assembly and the housing that is characterized by a high degree of concentricity. Poor concentricity has resulted in sufficient operating vibration to damage prior art pumps. Typically, the impeller will be fractured or otherwise damaged due to the vibrations and failure to maintain operating clearances. The bearing may be considered to operate on a film of molten metal, and poor concentricity yields reduced clearances which may cause the film to break down or not form so as to give rise to refractory material wear of increased rate.

SUMMARY OF INVENTION

The pumps and methods are characterized by unique fluid flow properties tending to provide improved pump performance.

In a first aspect of the invention, the fluid flow properties are enhanced by improved trueing or concentricity of the impeller within the base to reduce vibrations and fluid flow irregularities during pumping. More particularly, the impeller is secured to the shaft prior to finish forming or trueing the bearing ring receiving groove. The bearing ring is then secured within the bearing groove. By assuring the concentricity of the bearing within its mounting groove, vibrations due to non-balanced differences in the mass of the materials forming the bearing and impeller are reduced. Thereafter, the peripheral surface of the bearing ring is trued by mechanically shaping it and its concentricity about the shaft axis is assured with machining accuracy. The concentricity of the rotational movement of the bearing ring is thereby further improved and vibration during operation suppressed.

In another aspect of the present invention, an intake feed plate is positioned adjacent the pump inlet to screen or prohibit entry of solid debris into the pump. The feed plate is mounted for rotation, and it also provides a first stage impeller and pumping action that feeds the pump.

The use of volute pumping chamber configurations may be facilitated in accordance with a further aspect of the invention. Heretofore, the volute shape was typically achieved by fitting a circular chamber with a chord or crescent shape insert piece that results in a desired volute shape of increasing radius adjacent the discharge or outlet. More recently, computer numerically controlled machining centers enable direct forming of such designs. The rotational axis of the pump is aligned with the center of the circular chamber, and the volute pumping advantages are provided by altering the shape of the chamber through the use of the insert piece. This prior practice requires additional work in forming the enlarged preliminary circular shape and the subsequent fitting of the insert piece. In contrast with such techniques, the present invention contemplates the provision of a circular pumping chamber and an impeller mounted with its axis of rotation off-set from that of the chamber. In this manner, the volute shape is imparted to the space between the periphery of the impeller and the adjacent surface of the circular pumping chamber.

In yet a further aspect of the present invention, an improved impeller configuration includes peripheral pumping chambers that each have an axial intake through a radial intake opening at the top of the impeller and a radial discharge through an axial outlet opening extending along the outer peripheral side of the impeller. The chambers are disposed at an inclined angle relative to the direction of rotation to impose axial intake vector forces on the molten metal that operate to expedite metal flow into the pumping chamber. Thereafter, the centrifugal forces impose radial forces on the rotating metal causing ejection thereof from the pumping chamber. This impeller configuration thereby imposes two stage pumping and has provided increased pumping effectiveness in that relatively high flows and pressures are achieved.

DETAILED DESCRIPTION OF THE INVENTION

Figure 1:
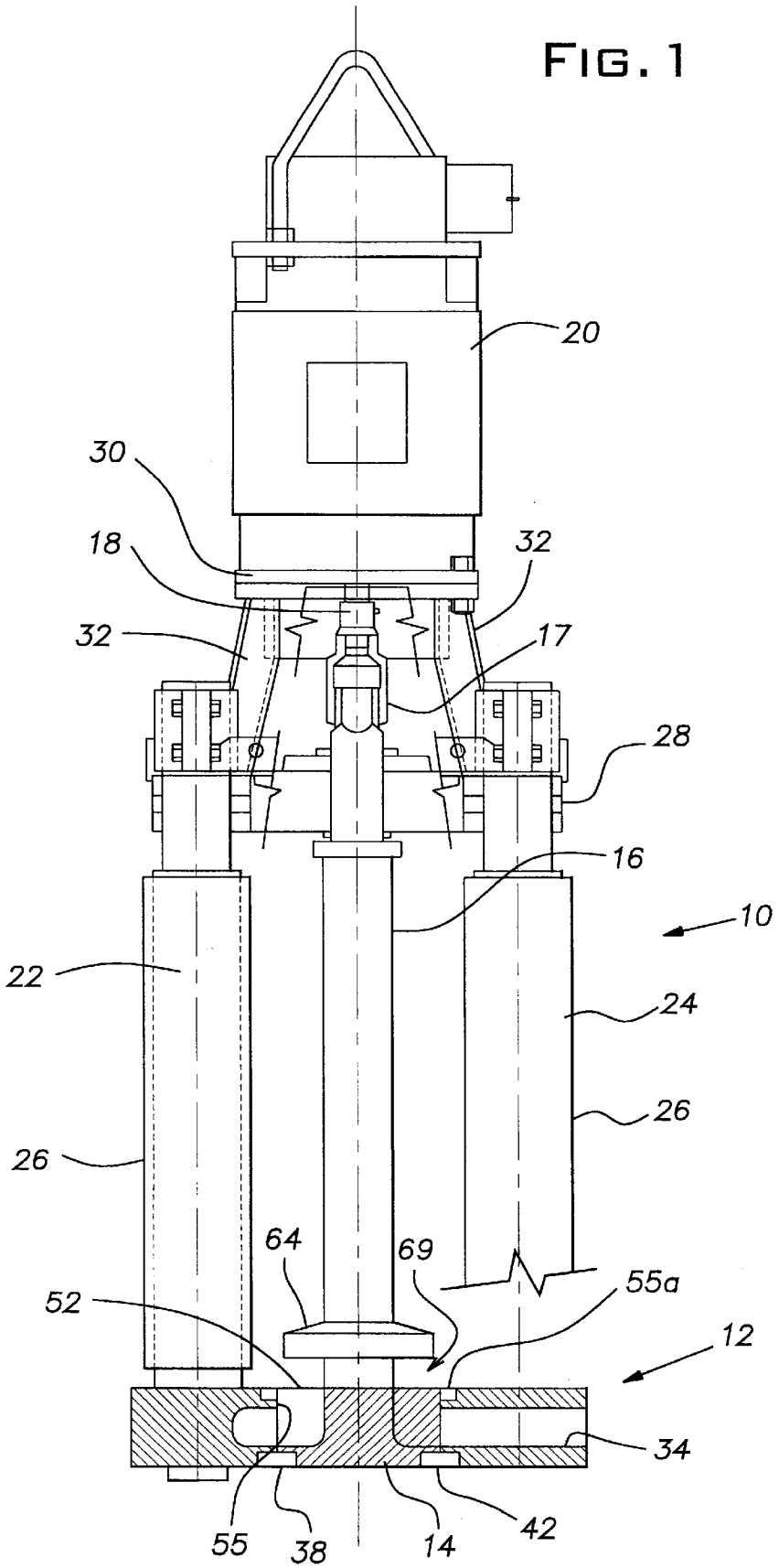
FIG. 1 is a side view, partly in section, of a molten metal pump.

Referring to FIG. 1, a molten metal pump 10 includes a casing or base member 12 having an impeller 14 mounted therein. The impeller 14 is secured to a shaft 16 and mounted for rotation within the base member 12. The shaft 16 may be formed of a refractory material such as graphite and provided with a protective coating of a refractory material such as silicon carbide or boron nitride. The upper end of the shaft 16 is connected via a coupling 17 with an upper shaft 18 to a motor 20. The motor 20 may be of any desired type and, for example, may be air or electric driven.

The pump 10 includes support posts 22 and 24. The posts are provided with protective sleeves 26 also formed of a refractory material, for example, as is known in the art. The post 22,24 are connected to a support plate 28. In a known manner, the motor 20 is mounted to a motor support platform 30 by means of struts 32. The lower ends of the posts 22 and 24 are attached to the base 12 by means of a refractory cement and/or mechanical fasteners.

The pump 10 is a circulation pump and includes a pump outlet passage 34 from which the metal is discharged for circulation within a vessel (not shown). A riser (not shown) may be connected to the outlet passage 34 to form a transfer pump. Gas may be injected into the passage 34 to provide a gas injection pump.

The pump 10 has a top feed orientation, and molten metal access is provided through the upper regions of the base 12. For convenience, a generally open configuration is shown, even though preliminary debris screening arrangements may be provided. The impeller 14 may be secured to the shaft 16 by means of a threaded connection, cement and/or mechanical interference members such as pins.

A lower impeller bearing 38 engages a lower base bearing 42. The bearings comprise ring members of refractory material such as silicon carbide adhesively mounted within bearing support grooves. As discussed in greater detail below, the pump 10 and the bearings 38 may be mounted or assembled and thereafter trued in the assembled condition to provide improved concentricity with the pump axis. In this manner, operational vibration is reduced and pump life is increased.

Figure 2:
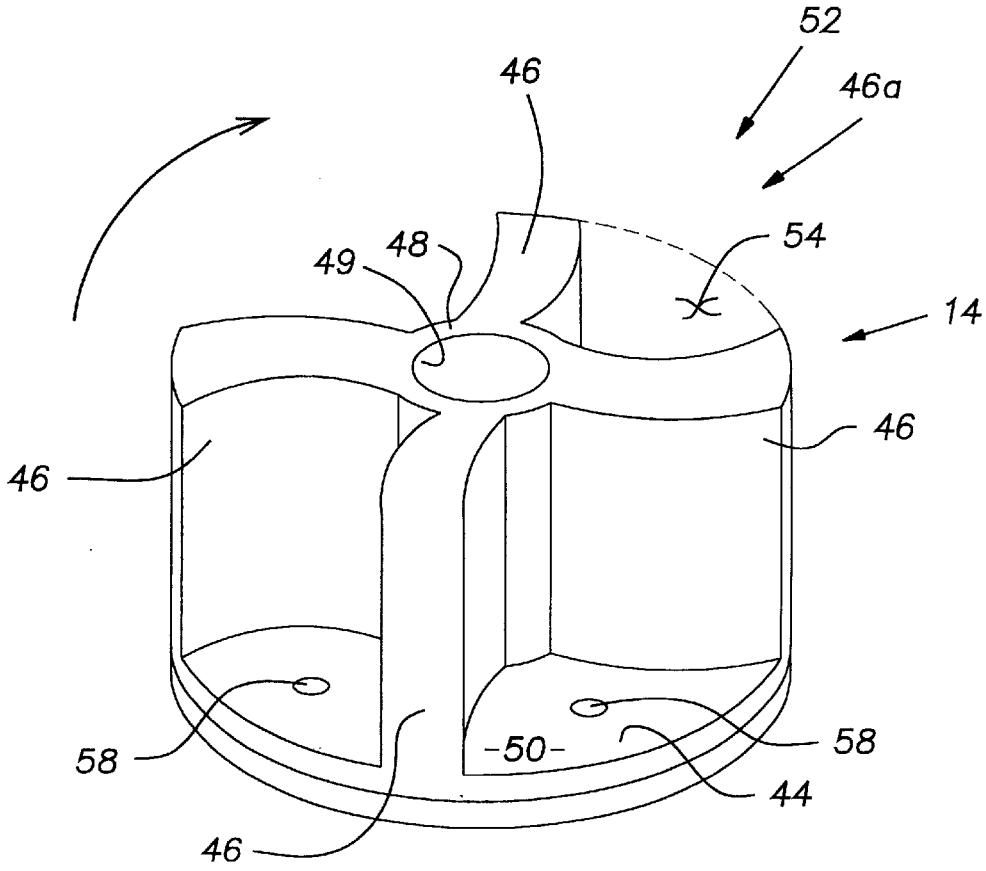
FIG. 2 is a perspective view on. an enlarged scale of an impeller from the pump of FIG. 1.

Referring to FIGS. 1 and 2, the impeller 14 includes a radially extending member or base 44, angularly spaced vanes 46 and a central hub 48 having a shaft receiving opening 49. The vanes 46 extend radially from the hub 48 and project axially from an upper surface 50 of the base 44 to cooperatively form a vane array 46*a* that has a generally cylindrical outline defined by the extremities of the vanes 46. The upper terminal extremities of the vanes 46 collectively define an impeller upper inlet 52.

In the illustrated embodiment, the upper inlet 52 is formed by openings 54 extending radially between adjacent vanes 46. The opening 54 generally extends in a radial plane between adjacent vanes, and the peripheral boundary for one of the openings 54 is shown in phantom outline in FIG. 2. Accordingly, molten metal enters the impeller through upper inlet 52 via downward flow into each of the openings 54.

The casing or base member 12 includes an upper casing opening 55 for passage of molten metal into the upper inlet 52 of the impeller 14. A wear ring 55*a* is positioned around the opening 55. The ring 55*a* is formed of a refractory material and provides radial and axial wear surfaces of increased hardness about the opening 55 for receipt of molten metal passing through the opening 55 and into the impeller upper inlet 52.

Figure 3:
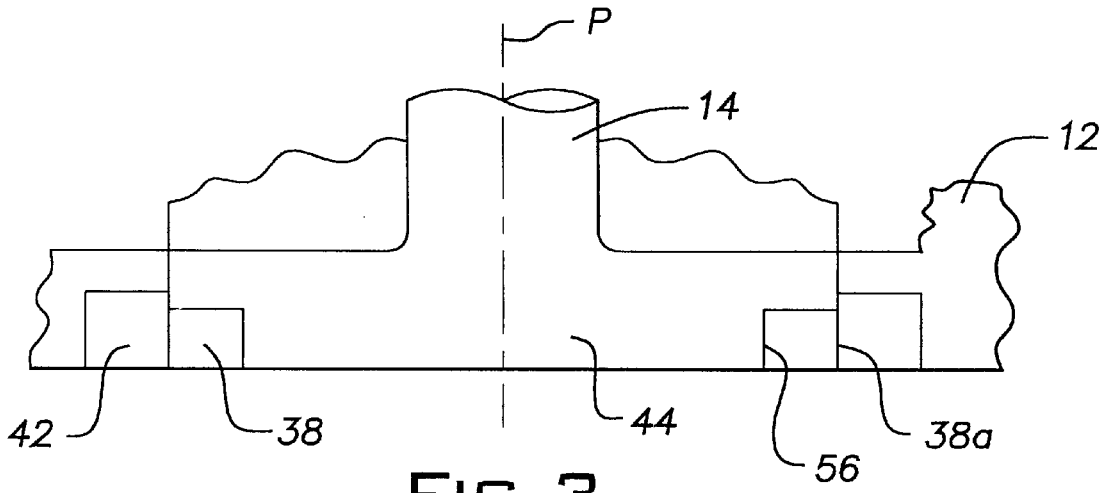
FIG. 3 is a fragmentary side view, partly in section, of the molten metal pump of FIG. 1 showing the details of the mounting of the impeller.

Referring to FIG. 3, the lower pump bearing 38 is shown in engagement with the lower base bearing 42. Each of these bearings has a circular configuration. In accordance with the present invention, the bearing 38 is mounted in a bearing groove 56 formed in the base member 44 of the impeller 14.

In order to improve the concentricity of the bearing mounting, the impeller 14 is fixed to a trueing shaft to form an assembly thereof, and the assembly is mounted in a fixture providing rotation of the impeller about the shaft axis. The bearing groove 56 is formed in the base member 44 during rotation of the assembly in order to assure that the groove 56 is circular and located on center. Thereafter, the bearing ring 38 is permanently fixed within the groove 56 and the peripheral surface is trued in order to assure concentricity of the bearing 38, or more particularly, the peripheral bearing surface 38*a* about the shaft axis. The impeller 14 may then be assembled to the shaft 16.

The improvements in concentricity have been found to substantially reduce the level of vibration and/or chatter of the pump during operation. This reduction in vibration has, in turn, been found to increase pump life as well as components such as the shaft, posts, refractory bearings or the case itself.

As shown most clearly in FIG. 2, the impeller 14 has curved vanes 46. More particularly, the vane has a so-called trailing curve in that the terminal radial extremities of the vane form an obtuse angle with a tangent at the periphery of the base at the radial extremity. Of course, the vanes 46 may be provided with a forward curve wherein an acute angle is provided with the tangent, or they may be "straight" vanes (i.e. no curve).

The pump apparatus also provides for safe drainage of molten metal during removal of the pump from the molten metal for service or the like. The openings 58 between vanes 46 drain molten metal from the pockets or otherwise retained by the impeller when it is lifted from the molten metal bath for service or replacement. It has been found that the openings may be sized to permit drainage of molten metal without freezing and entrapment of residue molten metal. This drainage is particularly effective when the pump is mounted with the radial member 44 in the lower position adjacent the lower extremities of the impeller. The longitudinal axis of the opening 58 may be parallel with the pump axis P.

In a like manner, the openings 58 permit molten metal flow into the impeller as it is initially submerged or placed in the molten metal. This limited initial flow into the interior regions of the impeller and onto the surfaces thereof preheats the impeller and distributes the heat load. This reduces the thermal shock upon initially installing and submerging the pump in the molten metal. This preheating is particularly effective when the radial member 44 is adjacent the lower extremities of the impeller. When the radial member is located at the upper extremities of the impeller, the openings 58 permit the escape of air as the impeller is submerged in the molten metal.

Figure 2A:
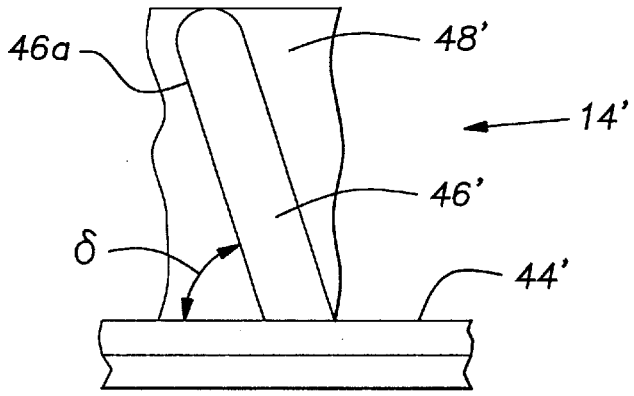
FIG. 2*a* is a fragmentary elevational view showing a modified impeller similar to that in FIG. 2 in accordance with another embodiment of the invention.

Referring to FIG. 2*a*, a modified impeller 14' is substantially identical with the impeller 14 except the vanes 46' are inclined in the direction of rotation. A leading vane surface 46*a'* imposes an axially downward force upon the molten metal within the impeller 14' so as to enhance the intake of molten metal. The inclination of the vane 46' is equal to the angle and may range from a fraction of a degree to about 60°.

Referring to FIGS. 1, 4, 4*a* and 4*b*, an intake feed plate 64 is secured to the shaft 16 for rotation therewith. The plate 64 is of disc-shape including an upper radial surface 65 having a chamber 65*a*, a lower radial surface 66 and a peripheral axial surface 67. A plurality of pumping chambers or slots 68 extend through the axial thickness of the plate 64, and have slot intake openings 68*a* in the radial surface 65 communicating with slot discharge openings 68*b* (FIG. 4*b*) in the surface 66.

The plate 64 is positioned above the impeller upper inlet 52 to prevent entry into the vane array of large particles, debris or other contaminants of sufficient size to cause catastrophic pump failure. To that end, the plate 64 cooperates with the adjacent surface of the base to define an annular pump inlet 69 as best shown in FIG. 1.

In addition to the foregoing filtering function, the plate 64 operates as a first stage impeller that feeds molten metal to the impeller 14 and, more particularly, the upper inlet opening 52. To that end, each of the slots 68 is inclined or tipped into the direction of rotation of the plate 64. More particularly, a slot axis "A" contained in a plane bisecting the slot 68 forms an angle $\alpha$ of 30° with the vertical and inclined or tipped into the direction of rotation. The angle $\alpha$ may vary from 1° to 60° or greater and, more preferably, from 10° to 45°. In this manner, molten metal is drawn into the intake opening 68*a* and a downward vector force is applied to the molten metal to cause its discharge through slot discharge opening 68*b*.

The flow of molten metal provided by the plate 64 may be selected in accordance with the operating characteristics of the impeller 14 to maximize the overall flow through the two pumping operations or stages. In cases of high flow circulating pumps, the plate 64 may be similarly designed with a high flow capacity. Accordingly, the total number of slots, the size of the slots and the angle of inclination may be varied.

The illustrated plate 64 includes 12 slots 68 equally spaced at 30° intervals. Each slot 68 has a major cross opening radial length dimension of about 1.3" and a minor transverse dimension of about 0.5". The slots 68 are inclined at an angle of about 30° into the direction of rotation with the intake opening 68*a* leading the discharge opening 68*b*. In addition to varying the number of slots, the cross-sectional shape may be varied, e.g. circular, and combinations of different cross-sectional shapes may be used as long as the balance of the plate 64 is maintained to allow smooth rotational movement.

Figure 5:
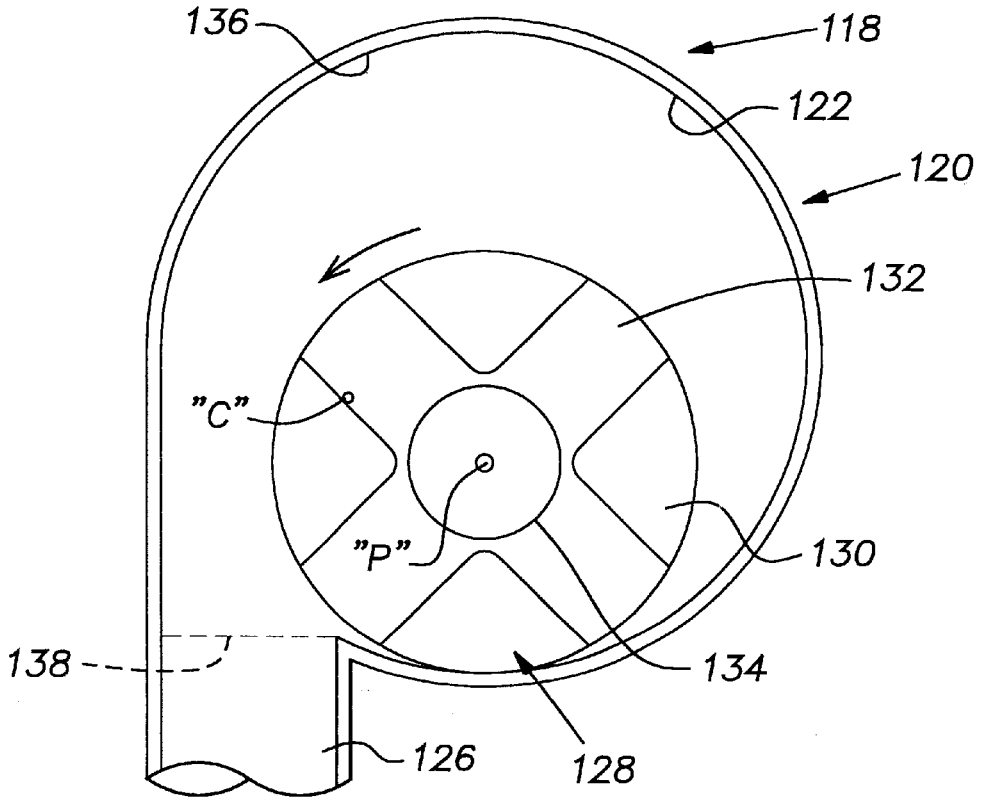
FIG. 5 is a schematic sectional plan view of a molten metal pump including a pump base having an impeller and volute pumping chamber in accordance with another aspect of the present invention.
Figure 4:
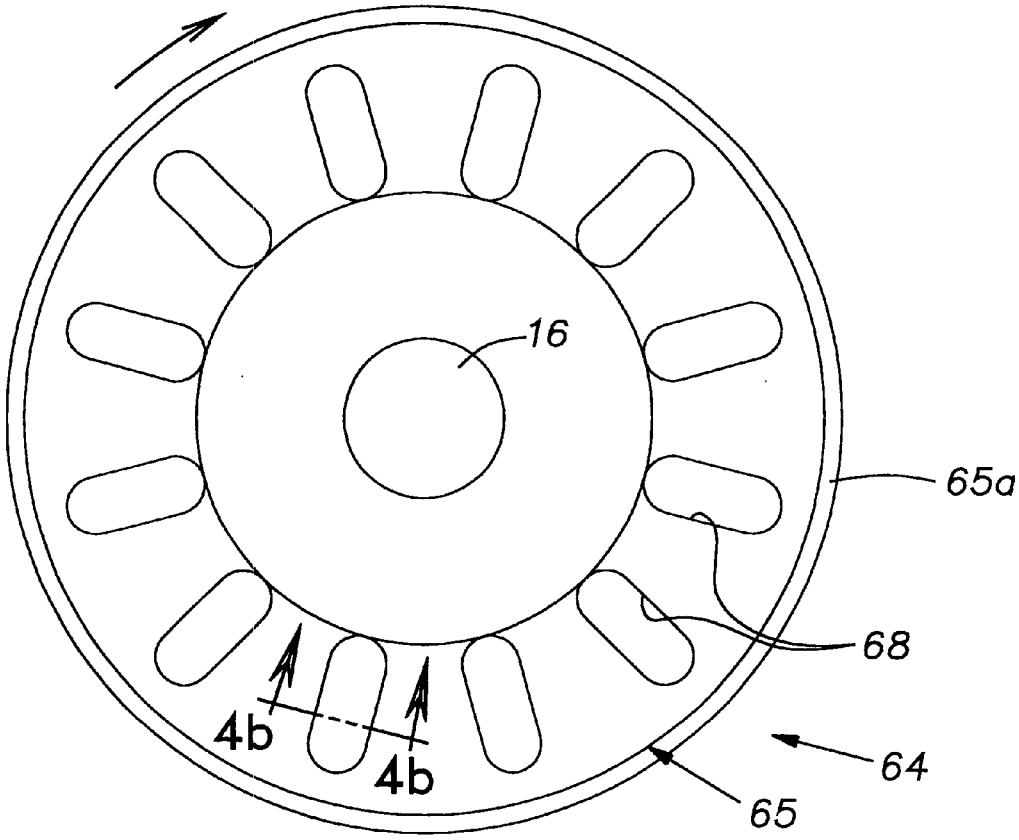
FIG. 4 is a top plan view of an intake feed plate for preliminary or first stage pumping of molten metal.
Figures 4A, 4B:
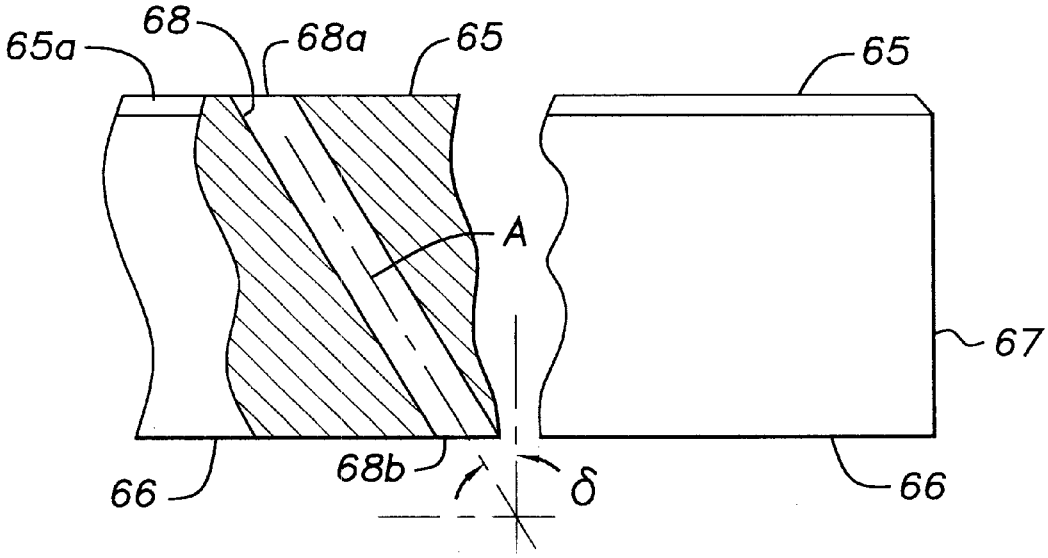
FIG. 4*a* is a fragmentary elavational view on an enlarged scale of the feed plate of FIG. 4.
FIG. 4*b* is a sectional view taken along the line 4*b*—4*b* in FIG. 4 and on an enlarged scale.

Referring to FIG. 5, the lower portions of a molten metal pump 118 is shown. More particularly a pump base 120 has a generally circular configuration and includes a pumping chamber 122. The pumping chamber 122 has a circular cross-section including a center "C". A pump outlet passage 126 intersects the periphery of the pumping chamber 122 at a location remote of the chamber diameter. An impeller 128 is positioned within the pumping chamber 122. The impeller 128 includes a base member 130, vanes 132 and hub 134. The pump 118 is arranged so that the impeller axis "P" is located adjacent the pump outlet passage 126. The impeller 128 is arranged so that the radial extremities of the vanes 132 form an increasing angle with the adjacent wall of the pumping chamber and a relatively larger cross-sectional area in a direction approaching the entrance to the outlet passage 126.

As shown in FIG. 5, the radial vane in the 8 o'clock position has just passed the entrance 138 to the outlet passage 126. As the 8 o'clock vane continues to rotate, it forms an increasing angle with the adjacent surface 136 of the chamber 122. During this portion of the rotation, the molten metal is received within the impeller inlet. As the 8 o'clock vane approaches the entrance 138 (schematically shown in dotted line) to the outlet passage 126, the angle between the radial extremities of the vane and inside of the chamber 122 increases and the velocity of the molten metal decreases, and the pressure of the molten metal in front of the 8 o'clock vane increases. Upon discharge, the molten metal is at substantially its maximum pressure. In this manner, the offset of the pumping chamber center "C" and in the impeller axis P relative to the location of the outlet passage 126 simulate a volute construction and operation.

Figure 7:
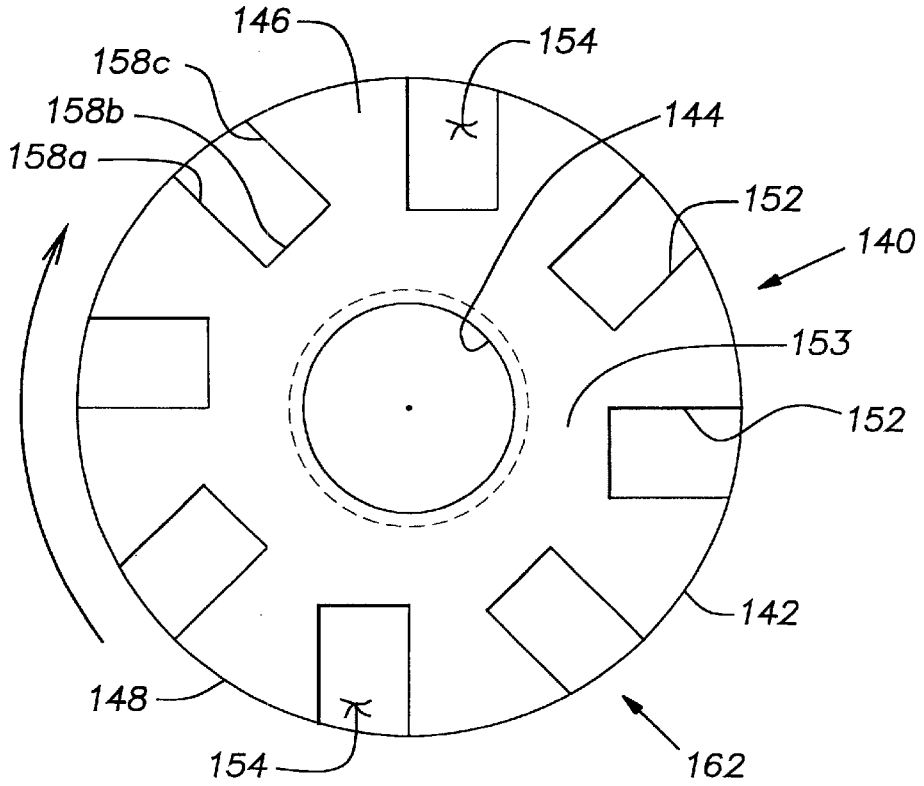
FIG. 7 is a plan view of the impeller of FIG. 6.
Figure 6:
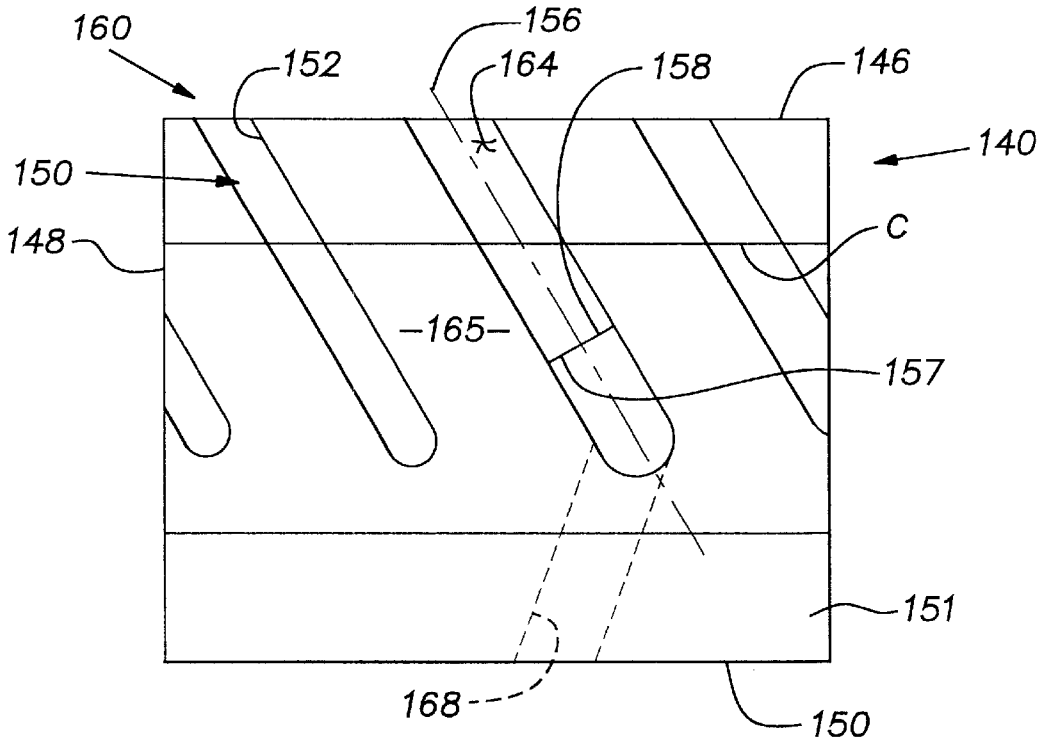
FIG. 6 is an elevational view of an impeller having pumping chambers in accordance with a further embodiment of the invention.

Referring to FIGS. 6 and 7, an impeller 140 in accordance with a further embodiment of the invention is shown. The impeller 140 has a generally cylindrical body 142 including a central shaft opening 144 which may be provided with internal threads for engaging a shaft (shown in dotted outline). The body 142 has an upper radial surface 146, a cylindrical side surface 148 and a lower radial surface 150. A lower impeller bearing 151, similar to the bearing 38 in the first embodiment, is located adjacent the bottom periphery of the impeller 140 for engagement with a base or housing bearing. The bearing 151 may be trued in the same manner as described above in respect to the bearing 38.

The impeller 140 also includes a plurality of elongate peripheral pumping chambers 152 that each intersect the radial surface 146 or extremity of the impeller to form chamber openings 154. The chambers 152 extend to an axial terminal end spaced from the bearing 151.

Each of the chambers 152 has a chamber length extending along a longitudinal axis 156 and a transverse cross-sectional area 157 extending in a right angle plane 158. The cross-sectional shape of the pumping chamber 152 is generally rectangular, but it may be of any suitable polygonal shape or circular.

As shown, the chamber length as measured along axis 156 is substantially greater than the major dimension of the cross-section measured in the plane 158. The ratio of chamber length to major cross-section dimension may be 3:1 to 20:1. Illustrative sizes of pump chamber lengths range from 2 to 6".

For convenience, the impeller is shown in a top feed orientation, and includes an upper impeller-inlet 160 collectively defined by radially extending openings 154 provided by the upper axial extremities of the impeller. An impeller outlet 162 is provided by openings 164 formed in the radial or peripheral extremities of the impeller along the length of each of the pumping chambers 152.

It should be appreciated that the pumping chamber 152 of the impeller 140 has a much smaller volume than that of a "vane pocket" of a vane impeller such as the impeller 14. The volume of a vane pocket corresponds with the volume between adjacent vane surfaces and within the upper, lower and peripheral extremities of the vane. The pumping chambers in accordance with the invention may be of substantially the same size as the vane pockets in a similarly sized (diameter) vane style pump as shown by comparison of FIG. 2*a* and FIG. 2. However, the pumping chamber will provide an increased pumping capacity in terms of weight/unit time, typical increases are in the range of above 25%.

As compared with vane impellers, the use of an increased number of smaller pumping chambers is preferred. This is believed to achieve more uniform flow and steady pump operation characterized by reduced vibrations. If the impeller is considered to have a generally cylindrical shape, the impeller 140 has a greater bulk density (i.e. weight/volume) than a vane impeller of similar size and pumping capacity.

Upon comparison of a typical 10" diameter four-vane impeller and a 10" diameter impeller having eight pumping chambers in accordance with the invention, the former has a total peripheral vane or web thickness of about 6" and the latter has a peripheral web or chamber wall thickness of about 9". Accordingly, the pumping chamber impeller enables a thicker web per volume of molten metal pumped. Even though the pumping chambers are relatively smaller, the pumping capacity is greater as noted above.

The pumping chambers 152 are preferably angularly spaced about the periphery of the impeller 140 in a uniform pattern. In the illustrated embodiment, the pumping chambers 152 are substantially located in the outer ⅓ of the diametrical extent of the cylindrical body 142 of the impeller 140. That is, about ⅔ of the diametrical extent of the impeller 140 provides a hub 153 of the impeller 140. The pumping chambers may be positioned on the outer ½ of the diametrical extent of the impeller 140 and the resulting hub will still comprise about ½ of the diametrical extent.

The peripheral location of the pumping chambers is preferred since the highest impeller surface speeds and centrifugal forces are encountered at the periphery. This tends to eject any particulate contaminates and reduce the tendency for blockage to occur.

As best shown in FIG. 6, the periphery of the impeller 140 includes alternating outlet openings 164 and solid surfaces 165. As measured along a circle "C" formed at the impeller periphery by a right angle plane, the total of the arcuate dimensions of the outlet openings 164 is less than the solid surfaces between the openings. Accordingly, the total of the arcuate dimensions of the outlet openings 164 is less than one-half of the circumference of the circle.

The total number of chambers and the dimensions of the chambers may be varied in accordance with the desired pumping flows. Typically, the chambers are located at equally spaced angular locations about the periphery of the impeller. Favorable results have been obtained with a total of eight pumping chambers spaced at 45° intervals. However, as few as three chambers and more than eight chambers may be used.

In an illustrated embodiment, each peripheral pumping chamber 152 is provided with a linear angle of inclination in the direction of rotation equal to about 30° from the vertical. However, this angle may vary from a fraction of a degree up to about 60° or greater. Again, the particular angle need only be sufficient to provide the desired intake force vector and intake flow. The intake vector force on the molten metal may be applied along a part of or along the entire length of the pumping chamber in a downward or upward direction depending upon the top or bottom intake orientation of the impeller. The pumping chamber may be provided with a nonlinear angle of inclination in the direction of rotation in the form of a helix. In the latter case, the imposed intake vector force varies along the length of the pumping chamber.

The chamber 152 includes three flat walls 15*a*, 158*b* and 158*c* (FIG. 7), and opening 164 (FIG. 6) extending in the plane of the side surface 148 of the body 142. In this manner, the walls 158*a*, 158*b* and 158*c* cooperate to provide the chamber 152 with a channel-shaped cross-section having a bight provided by opening 164. The intake vector forces are applied to the molten metal by the radially extending, rotationally trailing flat wall 158*a*. As the chamber 152 rotates, centrifugal force causes fluid or molten metal to be radially ejected from the chamber through opening 164. The intake vector forces continuously bias additional molten metal into the chamber 152 replacing the ejected molten metal.

The impeller 140 may be provided with a lower inlet/drain 166 formed by openings 168 (only one being shown in dotted outline) communicating between the pumping chambers 152 and the surface 150 of the impeller. The opening 168 is inclined and arranged to impose an intake vector force on the molten metal along the length of the opening in an upward direction in the illustrated embodiment. The molten metal entering the pumping chambers 152 through the openings 168 is ejected through the openings 164.

Each of the openings 168 may have its longitudinal axis parallel with that of the axis of rotation of the impeller 140. In either orientation, the openings 168 also provide the drain and the thermal shock reduction properties of the openings 58 in the first embodiment.

Figure 8:
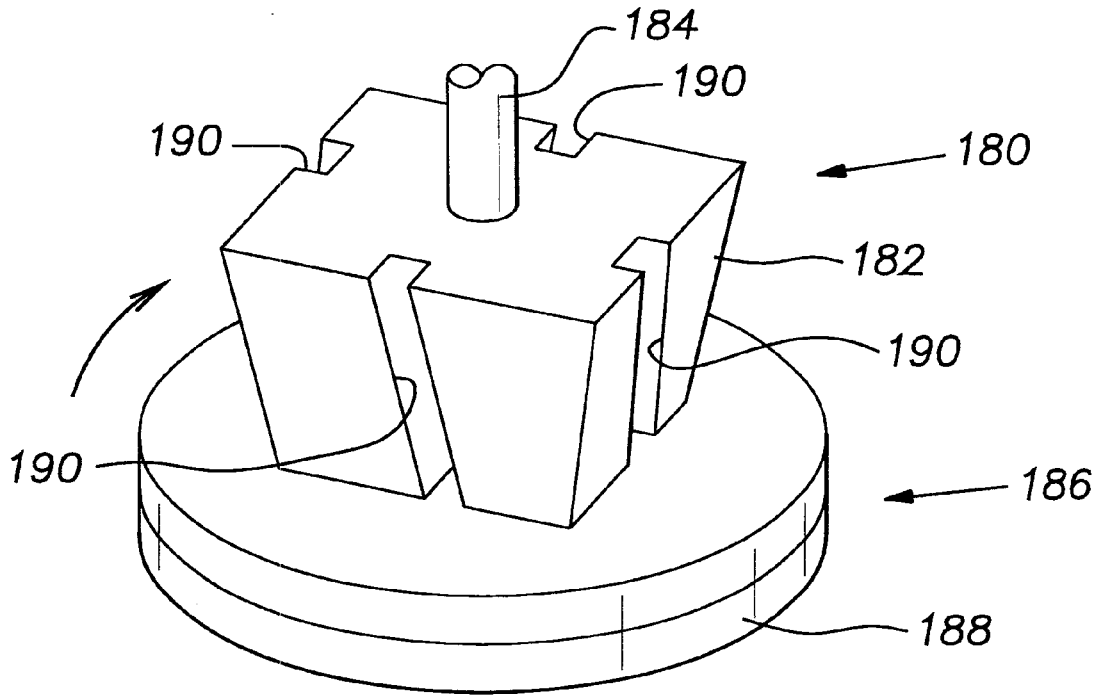
FIG. 8 is a perspective view of a cube-shaped impeller having pumping chambers in accordance with another embodiment of the invention.

Referring to FIG. 8, an impeller 180 having a generally cube-shaped body 182 is shown. The body 182 may have any convenient shape and, for example, a polygonal cross-section that is preferably regular or symmetrical about an axis of rotation. The impeller 180 is connected to a shaft 184 for clockwise rotation as shown in FIG. 8.

The impeller 180 also includes a circular base or mounting plate 186 that may be integrally formed or subsequently secured to the body 182. A bearing 188 is secured to the mounting plate 186 for engagement with a mating bearing in a pump base or housing. As disclosed above, the bearing 188 may be trued after the impeller 180 has been secured to the shaft 184.

The body 182 includes a plurality of pumping chambers 190 symmetrically positioned in each of the side faces of the body 182. The pumping chamber 190 is configured similar to the pumping chamber 152 and includes three flat walls and an opening in the side face of the body 182. As described above, the flat wall imposes a vector force promoting the intake of molten metal into the pumping chamber 190.

Figure 8A:
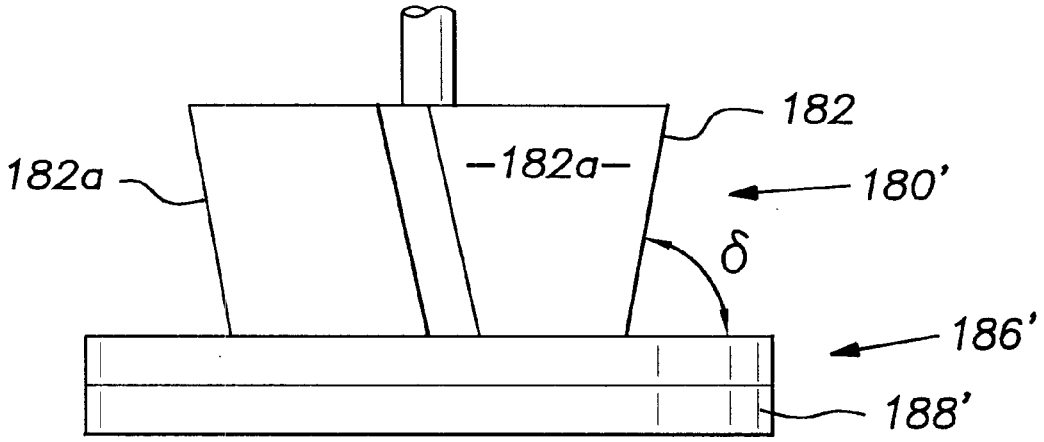
FIG. 8*a* is an elevational view showing a modified impeller similar to that in FIG. 8 in accordance with another embodiment of the invention.

Referring to FIG. 8*a*, a modified impeller 180' is substantially identical with the impeller 180 except the side faces 182*a* of the body 182' are radially inwardly inclined in a direction extending toward the base 186'. The angle of inclination may range from a fraction of a degree to about 60° or more in order to provide an axially downward force upon the molten metal within the impeller 180' so as to enhance the intake of molten metal.

Figure 9:
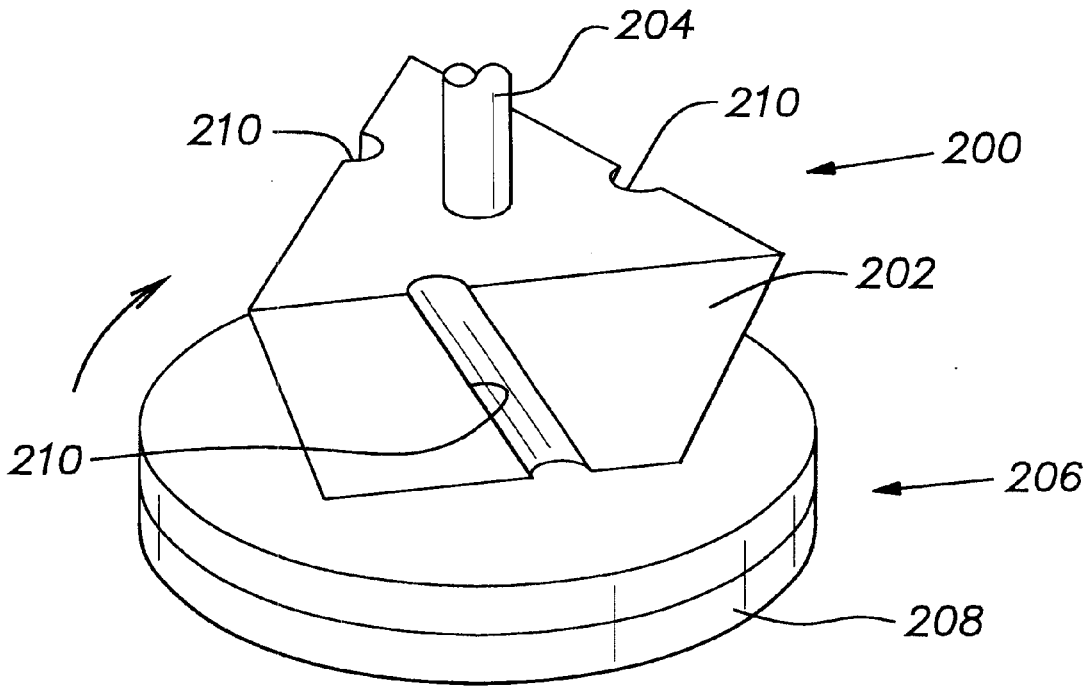
FIG. 9 is a perspective view similar of showing a triangle-shaped impeller having pumping chambers in accordance with another embodiment of the invention.

Referring to FIG. 9, an impeller 200 is shown. The impeller 200 includes a wedge-shaped body 202 connected to a shaft 204. The impeller 200 also includes a circular base or mounting plate 206 which may be integrally formed with the body 202. A bearing 208 is carried by the plate 206 for engagement with the base or housing bearing.

A pumping chamber 210 is disposed in each of the faces of the body 202. In this instance, the pumping chamber 210 has a cylindrical configuration and intersects the side face of the body 202 along the length thereof.

Figure 9A:
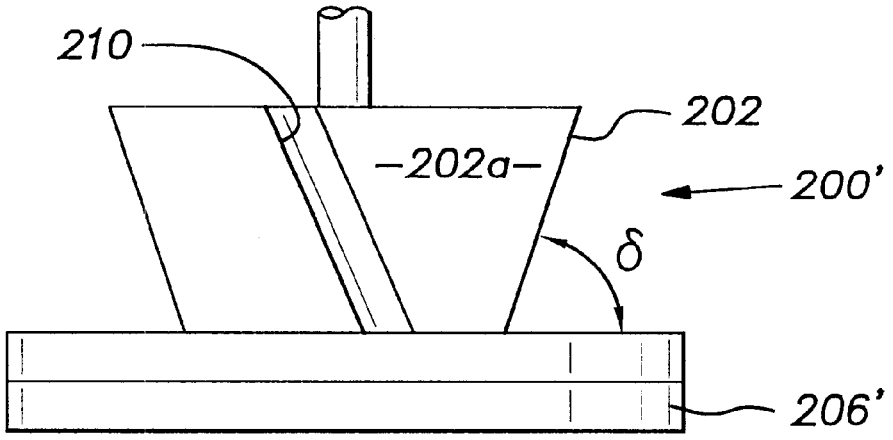
FIG. 9*a* is an elevational view showing a modified impeller similar to that in FIG. 9 in accordance with another embodiment of the invention.

Referring to FIG. 9*a*, a modified impeller 200' is substantially identical with the impeller 200 except the side faces 202*a* of the body 202' are radially inwardly inclined in a direction extending toward the base 206'. The angle of inclination may range from a fraction of a degree to about 60° or more in order to provide an axially downward force upon the molten metal within the impeller 180' so as to enhance the intake of molten metal.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A method of making an impeller assembly for a molten metal pump including a casing having a pumping chamber in which said impeller assembly is mounted, said impeller assembly including a shaft having an axis of rotation and opposed first and second shaft ends, an impeller fixed to one of said shaft ends, comprising the steps of mounting said impeller to a trueing shaft to form a trueing assembly, permanently mounting a ring bearing to said impeller, said ring bearing extending about said impeller and having an outer peripheral surface for engaging a casing bearing, and trueing said outer peripheral surface of said ring bearing by rotating said trueing shaft and simultaneously shaping said outer peripheral surface to provide the surface with a circular configuration about said trueing shaft axis.

2. A method as in claim 1, wherein the step of mounting said bearing to said trueing shaft includes rotating said trueing assembly and simultaneously cutting a bearing mounting groove in said impeller having a circular configuration about said trueing shaft axis.

3. A method of making a molten metal pump including a shaft having an axis of rotation and opposed first and second shaft ends, a drive motor operatively connected to said first shaft end, an impeller fixed to said second shaft end and a casing including a pumping chamber having said impeller mounted therein in a volute configuration, comprising the steps of providing said impeller with a plurality of vanes having radial extremities terminating in a circular pattern, fixing said impeller to said shaft to form an assembly, forming said pumping chamber with a circular cross-section having an axis extending through a chamber center in said casing and a sidewall having an inside surface extending about the periphery of said chamber along said circular cross-section with a uniform radial spacing from said chamber axis, forming a pump outlet having an entrance in said pumping chamber and an exit remote of said chamber, mounting said assembly to said casing with said impeller in said casing with said shaft axis off-set from said chamber axis so that the radial spacing and cross-sectional area between the radial extremities of the vanes and the inside surface of the sidewall of the pumping chamber increases in the direction of rotation approaching said entrance of said pump outlet.

4. A pump for pumping molten metal including a casing forming a pumping chamber having a casing inlet for intake of molten metal and a casing outlet for discharge of molten metal, an impeller mounted within said casing, said impeller being mounted to a shaft assembly and including an impeller inlet for receiving molten metal passing through said casing inlet, and a first stage pumping plate secured to said shaft for rotation remote of said casing, said plate including a plurality of plate chambers extending therethrough to pump molten metal into said casing inlet and impeller inlet.

5. An impeller as set forth in claim 4, wherein said plate chambers are inclined into the direction of rotation.

6. An impeller as set forth in claim 5, wherein said plate has opposed first and second plate surfaces, each of said plate chambers communicates between an intake opening in said first plate surface and a discharge opening in said second plate surface, and each of said plate chambers is inclined in the direction of rotation with said intake plate opening leading said discharge plate opening.

7. An impeller as set forth in claim 5, wherein said plate is sized and spaced from said casing to prevent debris contained in the molten metal from passing into said casing inlet.

8. An impeller as set forth in claim 7, wherein said plate has a radial extent substantially coextensive with that of said casing inlet and an axial spacing from said casing selected to inhibit passage therebetween of debris contained in the molten metal.

9. An impeller for a molten metal pump comprising a body portion including an axis of rotation, first and second radial surfaces joined by a peripheral side surface, and a plurality of pumping chambers spaced about the periphery of said body portion, each of said pumping chambers having an elongate, slot-like configuration extending in an axial direction along a chamber length and a cross-sectional area having a major dimension substantially less than said chamber length, an inlet opening in said first radial surface and a discharge opening in said peripheral side surface, and a wall portion inclined in the direction of rotation extending along substantially all of said chamber length to said peripheral side surface and said discharge opening.

10. An impeller as set forth in claim 9, wherein said discharge opening intersects said inlet opening at said first radial surface.

11. An impeller as set forth in claim 10, wherein said pumping chamber has a central axis extending along said pumping chamber length and said central axis extends at an inclined angle relative to the direction of rotation of said impeller.

12. An impeller as set forth in claim 11, wherein said inclined angle is a linear angle.

13. An impeller as set forth in claim 11, wherein said inclined angle is a non-linear angle.

14. The impeller of claim 9, wherein said pumping chamber includes a second wall portion that also extends to said discharge opening, said second wall portion opposing said first mentioned wall portion and also being inclined in the direction of rotation at substantially the same angle as said first mentioned wall portion.

15. The impeller of claim 9, wherein said wall portion imposes an intake vector force on molten metal entering said inlet opening along substantially all of said chamber length and said impeller also imposes a centrifugal force to radially discharge molten metal through said discharge opening during rotation of said impeller.

16. The impeller of claim 9, wherein said peripheral side surface has an axial length, and said pumping chamber and discharge opening extend along a substantial portion of the axial length of said peripheral side surface.

17. The impeller of claim 9, wherein said first and second wall portions are joined remote of said discharge opening and cooperate to provide said pumping chamber with a channel-shape having a bight that opens in said peripheral side surface to form said discharge opening and opposed first and second axial extremities spaced along said pumping chamber length, said first axial extremity opening in said first radial surface to form said inlet opening and said second axial extremity comprising a chamber end wall adjacent said second radial surface.

18. The impeller of claim 17, wherein said inlet opening intersects said discharge opening at said first radial surface.

19. The impeller of claim 18, wherein said peripheral side surface has an axial length, and said pumping chamber and discharge opening extend along a substantial portion of the axial length of said peripheral side surface.

20. The impeller of claim 19, wherein said pumping chamber has a central axis inclined in the direction of rotation from about 1° to about 60°.

21. The impeller of claim 20, wherein said pumping chamber channel-shape is a generally cylindrical shape and said wall portions comprise an arcuate wall.

22. The impeller of claim 20, wherein said pumping chamber channel-shape is a generally rectangular shape and said wall portions comprise planar or flat shape walls.

23. The impeller of claim 9, wherein said pumping chamber cross-sectional area intersects said peripheral side surface to form said discharge opening along substantially all of said chamber length.

24. The impeller of claim 23, wherein said impeller includes from about three to about eight of said pumping chambers, said pumping chambers being equally angularly spaced about said axis of rotation.

25. The impeller of claim 23, wherein said impeller has a generally cylindrical shape, and said pumping chambers are substantially-located in the outer one-third of the diametrical extent of the impeller.

26. The impeller of claim 9, wherein said impeller body portion has a generally cylindrical shape, said peripheral side surface including said discharge openings form a circle in a plane extending at a right angle to said axis of rotation and through said peripheral side surface, and the total of the arcuate dimensions of said discharge openings as measured along said circle is less than one-half of the circumference of said circle.

27. The impeller of claim 9, wherein said pumping chamber has a central axis extending along said pumping chamber length, said pumping length being measured along said central axis of the pumping chamber, said cross-sectional major dimension being measured in a plane extending at a right angle to said central axis, the ratio of said chamber length to said major dimension being in the range of from about 3:1 to 20:1.

28. The impeller of claim 23, wherein said impeller body portion has a polygonal cross-section including axially extending side faces, at least one of said side faces being radially inwardly inclined in a direction extending toward said base.

29. The impeller of claim 28, wherein said at least one side face is inclined at an angle in the range of from about 1° to about 60°.

30. The impeller of claim 29, wherein all side faces of said body portion are radially inwardly inclined.

31. A method of pumping molten metal by rotating an impeller submerged below the surface of the molten metal, said impeller having an axis of rotation and including a plurality of angularly spaced pumping chambers having associated intake openings in a first radial surface and discharge openings in a peripheral side surface that extends to a second radial surface, each of said pumping chambers having a chamber length and a wall portion inclined in the direction of rotation extending along substantially all of said chamber length to said peripheral side surface and said discharge opening, comprising the steps of imposing an intake force vector along said wall portion upon molten metal within said pumping chamber to cause intake flow of molten into said intake openings, and imposing centrifugal force upon molten metal within said pumping chamber to cause discharge of molten metal through said discharge openings.

32. The method of claim 31, wherein said pumping chamber and discharge opening are axially coextensive to continuously impose an intake force vector on said molten metal within said pumping chamber until it is ejected through said discharge opening.

33. An impeller for a molten metal pump comprising a body portion including an axis of rotation, first and second radial surfaces joined by an axially extending peripheral side surface, and a plurality of pumping chambers spaced about the periphery of said body portion, each of said pumping chambers having an elongate, slot-like configuration extending in an axial direction along a chamber length and a cross-sectional area having a major dimension substantially less than said chamber length, an inlet opening in said first radial surface and a discharge opening in said peripheral side surface, each of said pumping chambers including substantially equally spaced and opposed walls that extend along substantially all of said chamber length to said peripheral side surface to form said discharge opening, said opposed walls directing molten metal flow along a straight flow path through said pumping chamber.

34. An impeller as set forth in claim 33, wherein said opposed walls are inclined in the direction of rotation.

35. An impeller as set forth in claim 34, wherein said pumping chamber axially extends from said inlet opening in said first radial surface to a radially extending chamber end wall extending to said peripheral surface adjacent said second radial surface, and said discharge opening intersects said inlet opening at said first radial surface and axially extends to said chamber end wall.

36. An impeller as set forth in claim 35, wherein said opposed walls are flat or planar and cooperate to form a chamber interior surface remote of said discharge opening that directs molten metal in a single flow direction through said pumping chamber.

37. An impeller as set forth in claim 34, wherein said opposed walls have an arcuate-shape that forms a chamber interior surface remote of said discharge opening that directs molten metal in a single flow direction through said pumping chamber.

* * * * *